US009206374B2

(12) United States Patent
Jukes et al.

(10) Patent No.: US 9,206,374 B2
(45) **Date of Patent: *Dec. 8, 2015**

(54) TRUNK PISTON ENGINE LUBRICATING OIL COMPOSITIONS

(75) Inventors: Ronald Jukes, Rotterdam (NL); Todd Brookhart, Walnut Creek, CA (US); Christophe P. Le Deore, Montivilliers (FR)

(73) Assignees: Chevron Oronite SAS, Cedex (FR); Chevron Oronite Company LLC, San Ramon, CA (US); Chevon Oronite Technology B.V., Rotterdam (NL)

( * ) Notice: Subject to any disclaimer, the term of this patent is extended or adjusted under 35 U.S.C. 154(b) by 412 days.

This patent is subject to a terminal disclaimer.

(21) Appl. No.: 13/328,310

(22) Filed: Dec. 16, 2011

(65) Prior Publication Data

US 2013/0157912 A1 Jun. 20, 2013

(51) Int. Cl.

| | |
|---|---|
| ***C10M 141/10*** | (2006.01) |
| ***C10M 169/04*** | (2006.01) |
| ***C10M 137/10*** | (2006.01) |
| ***C10M 159/22*** | (2006.01) |
| ***C10M 163/00*** | (2006.01) |

(52) U.S. Cl.

CPC ..... *C10M 163/00* (2013.01); *C10M 2203/02* (2013.01); *C10M 2203/1006* (2013.01); *C10M 2207/262* (2013.01); *C10M 2215/28* (2013.01); *C10M 2223/045* (2013.01); *C10M 2229/02* (2013.01); *C10N 2220/027* (2013.01); *C10N 2230/04* (2013.01); *C10N 2230/40* (2013.01); *C10N 2230/52* (2013.01); *C10N 2240/102* (2013.01)

(58) Field of Classification Search

CPC ..... C10M 2215/28; C10M 2223/045; C10N 2210/02

USPC ..... 508/287, 294, 370, 460

See application file for complete search history.

(56) References Cited

U.S. PATENT DOCUMENTS

| | | | |
|---|---|---|---|
| 3,036,003 | A | 5/1962 | Verdol |
| 3,172,892 | A | 3/1965 | Le Suer et al. |
| 3,219,666 | A | 11/1965 | Norman et al. |
| 3,272,746 | A | 9/1966 | Le Suer et al. |
| 3,275,554 | A | 9/1966 | Wagenaar |
| 3,329,658 | A | 7/1967 | Fields |
| 3,438,757 | A | 4/1969 | Honnen et al. |
| 3,449,250 | A | 6/1969 | Fields |
| 3,454,555 | A | 7/1969 | Van Der Voort et al. |
| 3,565,804 | A | 2/1971 | Honnen et al. |
| 3,586,629 | A | 6/1971 | Otto et al. |
| 3,591,598 | A | 7/1971 | Traise et al. |
| 3,666,730 | A | 5/1972 | Coleman |
| 3,980,569 | A | 9/1976 | Pindar et al. |
| 4,234,435 | A | 11/1980 | Meinhardt et al. |
| 4,529,526 | A | 7/1985 | Inoue et al. |
| 4,612,132 | A | 9/1986 | Wollenberg et al. |
| 4,746,446 | A | 5/1988 | Wollenberg et al. |
| 4,943,672 | A | 7/1990 | Hamner et al. |
| 5,059,299 | A | 10/1991 | Cody et al. |
| 5,716,912 | A | 2/1998 | Harrison et al. |
| 5,733,839 | A | 3/1998 | Espinoza et al. |
| 6,165,235 | A | 12/2000 | Kolp et al. |
| 6,372,696 | B1 | 4/2002 | Tipton |
| 6,440,905 | B1 | 8/2002 | Epps et al. |
| 7,018,525 | B2 | 3/2006 | Miller et al. |
| RE39,073 | E | 4/2006 | Herbolzheimer et al. |
| 7,083,713 | B2 | 8/2006 | Abernathy et al. |
| 2004/0159582 | A1 | 8/2004 | Simmons et al. |
| 2005/0077208 | A1 | 4/2005 | Miller et al. |
| 2005/0133407 | A1 | 6/2005 | Abernathy et al. |
| 2005/0133409 | A1 | 6/2005 | Abernathy et al. |
| 2005/0139513 | A1 | 6/2005 | Miller |
| 2005/0139514 | A1 | 6/2005 | Miller |
| 2005/0227866 | A1 | 10/2005 | Berge et al. |
| 2005/0241990 | A1 | 11/2005 | Ziemer et al. |
| 2005/0261145 | A1 | 11/2005 | Rosenbaum et al. |
| 2005/0261146 | A1 | 11/2005 | Rosenbaum et al. |
| 2005/0261147 | A1 | 11/2005 | Rosenbaum et al. |
| 2006/0013210 | A1 | 1/2006 | Bordogna et al. |
| 2006/0016721 | A1 | 1/2006 | Miller et al. |
| 2006/0016724 | A1 | 1/2006 | Miller et al. |
| 2006/0076267 | A1 | 4/2006 | Miller |

(Continued)

FOREIGN PATENT DOCUMENTS

| | | |
|---|---|---|
| EP | 668342 | 8/1999 |
| EP | 776959 | 10/2004 |

(Continued)

OTHER PUBLICATIONS

U.S. Appl. No. 11/400,570, filed Apr. 7, 2006.

U.S. Appl. No. 11/535,165, filed Sep. 26, 2006.

U.S. Appl. No. 11/613,936, filed Dec. 20, 2006.

Singapore Search Report issued in counterpart Singapore Patent Application No. 201209260-7 dated Jan. 20, 2015.

*Primary Examiner* — Vishal Vasisth

(74) *Attorney, Agent, or Firm* — M. Carmen & Associates, PLLC

(57) ABSTRACT

Disclosed herein is a trunk piston engine lubricating oil composition comprising (a) a major amount of an oil of lubricating viscosity; (b) one or more carboxylate-containing detergents comprising a salt of an alkyl-substituted hydroxyaromatic carboxylic acid, wherein at least about 50% of the alkyl moiety of the alkyl-substituted hydroxyaromatic carboxylic acid comprises $C_{26+}$ alkyl groups derived from one or more normal alpha olefins; and (c) one or more zinc dithiophosphates in an amount of about 0.02 to about 0.12 wt. % in terms of phosphorus content.

19 Claims, No Drawings

(56) References Cited

U.S. PATENT DOCUMENTS

| | | | | |
|---|---|---|---|---|
| 2006/0201851 | A1 | 9/2006 | Rosenbaum et al. | |
| 2006/0289337 | A1 | 12/2006 | Rosenbaum et al. | |
| 2007/0027043 | A1 | 2/2007 | Le Coent | |
| 2009/0156440 | A1* | 6/2009 | Verlinde | 508/229 |
| 2010/0062957 | A1 | 3/2010 | Bertram et al. | |
| 2011/0077179 | A1* | 3/2011 | Van Houten et al. | 508/287 |
| 2011/0077182 | A1 | 3/2011 | Jukes | |

FOREIGN PATENT DOCUMENTS

| | | | |
|---|---|---|---|
| EP | 2071009 | A1 | 6/2009 |
| WO | 9920720 | A1 | 4/1999 |
| WO | 9934917 | A1 | 7/1999 |
| WO | 02077133 | A2 | 10/2002 |
| WO | 2005/107935 | | 11/2005 |

* cited by examiner

TRUNK PISTON ENGINE LUBRICATING OIL COMPOSITIONS

BACKGROUND OF THE INVENTION

1. Technical Field

The present invention generally relates to trunk piston engine lubricating oil compositions.

2. Description of the Related Art

Trunk piston engines operate using various types and qualities of diesel fuels and heavy fuel oils. Heavy fuel oils typically contain high concentrations of asphaltenes; generally the heaviest and most polar fraction of petroleum. Asphaltenes are highly complex compounds believed to be composed of polyaromatic sheets containing alkyl side chains, and are generally insoluble in lubricating oils. When heavy fuel oils and conventional lubricant oil compositions mix in different temperature regions of a trunk piston engine, black sludge (such as asphaltene deposits or other deposits) and other asphaltene derived deposits (such as undercrown deposits) tend to form. The formation of black sludge or deposits can adversely affect the service interval and maintenance cost of the trunk piston engine. Therefore, an important performance aspect of these lubricants is residual fuel compatibility.

Salicylates have for many years been found to be effective in reducing deposits in trunk piston engine oils, in particular deposits due to asphaltene deposition from residual fuels. A trunk piston engine is generally a medium speed, 4-cycle engine in which the connecting rod is attached directly to the piston. For many years, commercial salicylates used in trunk piston engine oils were derived from $C_{14}$ to $C_{18}$ olefins.

Recently it has been shown that salts of alkyl-substituted hydroxyaromatic carboxylic acids, wherein at least 90% of the alkyl groups are $C_{20}$ or greater, result in improved detergency in trunk piston engine oils. For example, U.S. Patent Application Publication No. 20090281009 which discloses a lubricating oil composition containing (a) a major amount of a Group I base oil and/or a Group II base oil; and (b) at least one detergent comprising a salt of an alkyl-substituted hydroxybenzoic acid, wherein at least 90% of the alkyl groups are $C_{20}$ or greater, wherein the lubricating oil composition is a medium or high soap formulation.

U.S. Patent Application Publication No. 20070027043 ("the '043 application") discloses a process for preparing an overbased alkaline earth metal alkylhydroxybenzoate wherein the alkyl moiety of the alkylhydroxybenzoate is a linear aliphatic group having from about 12 to 40 carbon atoms, a branched aliphatic group having from about 9 to 24 carbon atoms or a mixture of linear and branched aliphatic groups. The '043 application further discloses that the overbased alkaline earth metal alkylhydroxybenzoate is useful as a lubricating oil additive in lubricating oil compositions for the lubrication of mechanical components in land and marine engines such as, for example, hydraulic systems, transmissions, two-stroke and four-stroke vehicular engines, trunk piston and two stroke crosshead marine engines.

U.S. Patent Application Publication No. 20100062957 which discloses a method of reducing asphaltene precipitation (black paint) in an engine by lubricating the engine with a lubricating oil composition comprising, or made by admixing (A) an oil of lubricating viscosity in a major amount; and (B) a salicylate detergent system in a minor amount comprising one or more neutral or overbased alkaline earth metal $C_{22}$ hydrocarbyl substituted salicylates; with the proviso that the salicylate detergent system does not include an alkali metal salicylate.

Heretofore, there has been no recognition or appreciation that a salt of an alkyl-substituted hydroxyaromatic carboxylic acid, wherein the alkyl moiety of the alkyl-substituted hydroxyaromatic carboxylic acid comprises $C_{26+}$ alkyl groups derived from one or more normal alpha olefins, significantly and unexpectedly improves heavy fuel oil compatibility in a trunk piston engine lubricating oil composition containing a major amount of an oil of lubricating viscosity and one or more zinc dithiophosphates in an amount of about 0.02 to about 0.12 wt. % in terms of phosphorus content.

SUMMARY OF THE INVENTION

In accordance with one embodiment of the present invention, there is provided a trunk piston engine lubricating oil composition comprising (a) a major amount of an oil of lubricating viscosity; (b) one or more carboxylate-containing detergents comprising a salt of an alkyl-substituted hydroxyaromatic carboxylic acid, wherein at least about 50% of the alkyl moiety of the alkyl-substituted hydroxyaromatic carboxylic acid comprises $C_{26+}$ alkyl groups derived from one or more normal alpha olefins; and (c) one or more zinc dithiophosphates in an amount of about 0.02 to about 0.12 wt. % in terms of phosphorus content.

In accordance with a second embodiment of the present invention, there is provided a method for reducing black sludge and deposit formation in a trunk piston engine, comprising lubricating the trunk piston engine with a trunk piston engine lubricating oil composition comprising (a) a major amount of an oil of lubricating viscosity; (b) one or more carboxylate-containing detergents comprising a salt of an alkyl-substituted hydroxyaromatic carboxylic acid, wherein at least about 50% of the alkyl moiety of the alkyl-substituted hydroxyaromatic carboxylic acid comprises $C_{26+}$ alkyl groups derived from one or more normal alpha olefins; and (c) one or more zinc dithiophosphates in an amount of about 0.02 to about 0.12 wt. % in terms of phosphorus content.

In accordance with a third embodiment of the present invention, there is provided a method for operating a trunk piston engine comprising lubricating the trunk piston engine with a trunk piston engine lubricating oil composition comprising (a) a major amount of an oil of lubricating viscosity; (b) one or more carboxylate-containing detergents comprising a salt of an alkyl-substituted hydroxyaromatic carboxylic acid, wherein at least about 50% of the alkyl moiety of the alkyl-substituted hydroxyaromatic carboxylic acid comprises $C_{26+}$ alkyl groups derived from one or more normal alpha olefins; and (c) one or more zinc dithiophosphates in an amount of about 0.02 to about 0.12 wt. % in terms of phosphorus content.

In accordance with a fourth embodiment of the present invention, the use of one or more carboxylate-containing detergents comprising a salt of an alkyl-substituted hydroxyaromatic carboxylic acid, wherein at least about 50% of the alkyl moiety of the alkyl-substituted hydroxyaromatic carboxylic acid comprises $C_{26+}$ alkyl groups derived from one or more normal alpha olefins as an additive in a trunk piston engine lubricating oil composition comprising (a) a major amount of an oil of lubricating viscosity and (b) one or more zinc dithiophosphates in an amount of about 0.02 to about 0.12 wt. % in terms of phosphorus content for the purpose of reducing black sludge and deposit formation in a trunk piston engine is provided.

It has been surprisingly found that the use of one or more carboxylate-containing detergents comprising a salt of an alkyl-substituted hydroxyaromatic carboxylic acid, wherein at least about 50% of the alkyl moiety of the alkyl-substituted hydroxyaromatic carboxylic acid comprises $C_{26+}$ alkyl groups derived from one or more normal alpha olefins, as an additive in a trunk piston engine lubricating oil composition comprising a major amount of an oil of lubricating viscosity and one or more zinc dithiophosphates in an amount of about 0.02 to about 0.12 wt. % in terms of phosphorus content, significantly and unexpectedly decreases deposits due to asphaltene deposition in trunk piston engine oils. Thus, the addition of the one or more carboxylate-containing detergents to a trunk piston engine lubricating oil composition comprising a major amount of an oil of lubricating viscosity and one or more zinc dithiophosphates in an amount of about 0.02 to about 0.12 wt. % in terms of phosphorus content advantageously improves the heavy fuel oil compatibility of the trunk piston engine lubricating oil composition.

DETAILED DESCRIPTION OF THE PREFERRED EMBODIMENTS

To facilitate the understanding of the subject matter disclosed herein, a number of terms, abbreviations or other shorthand as used herein are defined below. Any term, abbreviation or shorthand not defined is understood to have the ordinary meaning used by a skilled artisan contemporaneous with the submission of this application.

The term "major amount" as used herein refers to a concentration of the oil of lubricating viscosity (also referred to as basestock) within the trunk piston engine lubricating oil composition of at least about 40 wt. %. In one embodiment, the term "major amount" refers to a concentration of the basestock within the trunk piston engine lubricating oil composition of at least about 50 wt. %. In another embodiment, the term "major amount" refers to a concentration of the basestock within the trunk piston engine lubricating oil composition of at least about 60 wt. %. In yet another embodiment, the term "major amount" refers to a concentration of the basestock within the trunk piston engine lubricating oil composition of at least about 70 wt. %. In still yet another embodiment, the term "major amount" refers to a concentration of the basestock within the trunk piston engine lubricating oil composition of at least about 80 wt. %. In another embodiment, the term "major amount" refers to a concentration of the basestock within the trunk piston engine lubricating oil composition of or at least about 90 wt. %.

The term "alkyl" refers to both straight- and branched-chain alkyl groups.

The term "phenate" means a metal salt of a phenol.

The term "alkylphenate" means a metal salt of an alkylphenol.

The term "alkylphenol" means a phenol having one or more alkyl substituents, wherein at least one of the alkyl substituents has a sufficient number of carbon atoms to impart oil solubility to the phenol.

The term "lime" refers to calcium hydroxide, also known as slaked lime or hydrated lime.

The term "metal" means alkali metals, alkaline earth metals, or mixtures thereof.

The term "alkaline earth metal" refers to calcium, barium, magnesium, and strontium.

The term "alkali metal" refers to lithium, sodium, potassium, rubidium, and cesium.

The term "metal base" refers to a metal hydroxide, metal oxide, metal alkoxides and the like and mixtures thereof, wherein the metal is an alkaline earth metal or alkali metal.

The term "overbased" refers to a class of metal salts or complexes. These materials have also been referred to as "basic", "superbased", "hyperbased", "complexes", "metal complexes", "high-metal containing salts", and the like. Overbased products are metal salts or complexes characterized by a metal content in excess of that which would be present according to the stoichiometry of the metal and the particular acidic organic compound reacted with the metal, e.g., a carboxylic acid. Suitable overbasing metals include alkaline earth metals such as magnesium, calcium, barium, and strontium. Suitable overbasing metals can be provided from the corresponding metal hydroxides, for example, calcium hydroxide and magnesium hydroxide provide the source for the alkaline earth metals calcium and magnesium, respectively. Additional overbasing can be achieved by the addition of acidic overbasing compounds for example, carbon dioxide and boric acid.

The term "Total Base Number" or "TBN" as used herein refers to the amount of base equivalent to milligrams of KOH in 1 gram of sample. Thus, higher TBN numbers reflect more alkaline products, and therefore a greater alkalinity reserve. The TBN of a sample can be determined by ASTM D 2896 or any other equivalent procedure.

The term "trunk piston engine oils" refers to oils used to lubricate both the crankcase and the cylinders of a trunk piston engine. The term "trunk piston" refers to the piston skirt or trunk. The trunk piston transmits the thrust caused by connecting-rod angularity to the side of the cylinder liner, in the same way as the crosshead slipper transmits the thrust to the crosshead guide. Trunk piston engines are generally medium speed (about 200 to about 2000 rpm) 4-stroke compression-ignition (diesel) engines. Accordingly, the trunk piston engine lubricating oil compositions, and trunk piston engine oils (TPEO) described herein (collectively "lubricating oil compositions") can be used for lubricating any trunk piston engine or compression-ignited (diesel) marine engine, such as a 4-stroke trunk piston engine or 4-stroke diesel marine engine.

The present invention is directed to a trunk piston engine lubricating oil composition containing (a) a major amount of an oil of lubricating viscosity; (b) one or more carboxylate-containing detergents comprising a salt of an alkyl-substituted hydroxyaromatic carboxylic acid, wherein at least about 50% of the alkyl moiety of the alkyl-substituted hydroxyaromatic carboxylic acid comprises $C_{26+}$, alkyl groups derived from one or more normal alpha olefins; and (c) one or more zinc dithiophosphates in an amount of about 0.02 to about 0.12 wt. % in terms of phosphorus content The oil of lubricating viscosity for use in the lubricating oil compositions of this invention, also referred to as a base oil or basestock, is typically present in a major amount, e.g., an amount of greater than 50 wt. %, or greater than about 70 wt. %, or from about 80 to about 99.5 wt. % or from about 85 to about 98 wt. %, based on the total weight of the composition. The expression "base oil" as used herein shall be understood to mean a base stock or blend of base stocks which is a lubricant component that is produced by a single manufacturer to the same specifications (independent of feed source or manufacturer's location); that meets the same manufacturer's specification; and that is identified by a unique formula, product identification number, or both. The base oil for use herein can be any presently known or later-discovered oil of lubricating viscosity used in formulating trunk piston engine lubricating oil compositions.

In general, the oil of lubricating viscosity for use in the trunk piston engine lubricating oil compositions of the present invention include those in API categories I, II, III, IV and V as defined in API Publication 1509, 14th Edition, Addendum I, December 1998. API guidelines define a basestock as a lubricant component that may be manufactured using a variety of different processes.

Group I basestocks generally refer to a petroleum derived lubricating base oil having a saturates content of less than 90 wt. % (as determined by ASTM D 2007) and/or a total sulfur content of greater than 300 ppm (as determined by ASTM D 2622, ASTM D 4294, ASTM D 4927 or ASTM D 3120) and has a viscosity index (VI) of greater than or equal to 80 and less than 120 (as determined by ASTM D 2270).

Group II basestocks generally refer to a petroleum derived lubricating base oil having a total sulfur content equal to or less than 300 parts per million (ppm) (as determined by ASTM D 2622, ASTM D 4294, ASTM D 4927 or ASTM D 3120), a saturates content equal to or greater than 90 wt. % (as determined by ASTM D 2007), and a viscosity index (VI) of between 80 and 120 (as determined by ASTM D 2270).

A Group III basestock generally has a total sulfur content less than or equal to 300 ppm (as determined by ASTM D 2622, ASTM D 4294, ASTM D 4927 or ASTM D 3120), a saturates content of greater than or equal to 90 wt. % (as determined by ASTM D 2007), and a viscosity index (VI) of greater than or equal to 120 (as determined by ASTM D 2270). In one embodiment, the basestock is a Group III basestock, or a blend of two or more different Group III basestocks. In general, Group III basestocks derived from petroleum oils are severely hydrotreated mineral oils. Hydrotreating involves reacting hydrogen with the basestock to be treated to remove heteroatoms from the hydrocarbon, reduce olefins and aromatics to alkanes and cycloparaffins respectively, and in very severe hydrotreating, open up naphthenic ring structures to non-cyclic normal and iso-alkanes ("paraffins"). Many of the Group III basestocks are available commercially, e.g., Chevron UCBO basestocks; Yukong Yubase basestocks; Shell XHV$^{I}$® basestocks; and ExxonMobil Exxsyn® basestocks.

In one embodiment, a Group III basestock for use herein is a Fischer-Tropsch derived base oil. The term "Fischer-Tropsch derived" means that the product, fraction, or feed originates from or is produced at some stage by a Fischer-Tropsch process. For example, a Fischer Tropsch base oil can be produced from a process in which the feed is a waxy feed recovered from a Fischer-Tropsch synthesis, see, e.g., U.S. Patent Application Publication Nos. 2004/0159582; 2005/0077208; 2005/0133407; 2005/0133409; 2005/0139513; 2005/0139514; 2005/0241990; 2005/0261145; 2005/0261146; 2005/0261147; 2006/0016721; 2006/0016724; 2006/0076267; 2006/013210; 2006/0201851; 2006/020185, and 2006/0289337; U.S. Pat. Nos. 7,018,525 and 7,083,713 and U.S. application Ser. Nos. 11/400,570, 11/535,165 and 11/613,936, each of which are incorporated herein by reference. In general, the process involves a complete or partial hydroisomerization dewaxing step, employing a dual-functional catalyst or a catalyst that can isomerize paraffins selectively. Hydroisomerization dewaxing is achieved by contacting the waxy feed with a hydroisomerization catalyst in an isomerization zone under hydroisomerizing conditions.

Fischer-Tropsch synthesis products can be obtained by well-known processes such as, for example, the commercial SASOL® Slurry Phase Fischer-Tropsch technology, the commercial SHELL® Middle Distillate Synthesis (SMDS) Process, or by the non-commercial EXXON® Advanced Gas Conversion (AGC-21) process. Details of these processes and others are described in, for example, WO-A-9934917; WO-A-9920720; WO-A-05107935; EP-A-776959; EP-A-668342; U.S. Pat. Nos. 4,943,672, 5,059,299, 5,733,839, and RE39073; and U.S. Patent Application Publication No. 2005/0227866. The Fischer-Tropsch synthesis product can contain hydrocarbons having 1 to about 100 carbon atoms or, in some cases, more than 100 carbon atoms, and typically includes paraffins, olefins and oxygenated products.

In another embodiment, the base basestock is at least one Group IV basestock, or polyalphaolefin (PAO). PAOs are typically made by the oligomerization of low molecular weight alpha-olefins, e.g., alpha-olefins containing at least 6 carbon atoms. In one embodiment, the alpha-olefins are alpha-olefins containing 10 carbon atoms. PAOs are mixtures of dimers, trimers, tetramers, etc., with the exact mixture depending upon the viscosity of the final basestock desired. PAOs are typically hydrogenated after oligomerization to remove any remaining unsaturation.

In one embodiment, the basestock for use herein can be a blend or a mixture of two or more, three or more, or even four or more of the Group I through Group IV basestocks, having different molecular weights and viscosities. The blend can be processed in any suitable manner to create a basestock having suitable properties such as, for example, viscosity and TBN values, as discussed hereinbelow, for use in a trunk piston engine.

The trunk piston engine lubricating oil compositions of the present invention will also contain a salt of an alkyl-substituted hydroxyaromatic carboxylic acid, wherein at least about 50% of the alkyl moiety of the alkyl-substituted hydroxyaromatic carboxylic acid comprises $C_{26+}$ alkyl groups derived from one or more normal alpha olefins. In one embodiment, at least about 50% of the alkyl moiety of the alkyl-substituted hydroxyaromatic carboxylic acid comprises $C_{26+}$ alkyl groups derived from a mixture of normal alpha olefins. In one embodiment, at least about 50% of the alkyl moiety of the alkyl-substituted hydroxyaromatic carboxylic acid comprises $C_{26}$ to $C_{28}$ alkyl groups derived from one or more normal alpha olefins. In another embodiment, at least about 50% of the alkyl moiety of the alkyl-substituted hydroxyaromatic carboxylic acid comprises $C_{26}$ to $C_{28}$ alkyl groups derived from a mixture of normal alpha olefins. The alkyl groups of the salt of an alkyl-substituted hydroxyaromatic carboxylic acid may contain linear groups, branched groups, or a mixture of linear and branched groups.

In one embodiment, at least about 60% (e.g., at least about 70%, at least about 75%, at least about 80%, at least about 90%, at least about 95%, or at least about 99%) of the alkyl groups contained within the alkyl-substituted hydroxyaromatic carboxylic acid salt detergent are $C_{26+}$ alkyl groups derived from one or more normal alpha olefins.

In one embodiment, at least about 60% (e.g., at least about 70%, at least about 75%, at least about 80%, at least about 90%, at least about 95%, or at least about 99%) of the alkyl groups contained within the alkyl-substituted hydroxyaromatic carboxylic acid salt detergent are $C_{26}$ to $C_{28}$ alkyl groups derived from one or more normal alpha olefins.

In one embodiment, a representative example of a suitable salt of a carboxylate-containing detergent that may be useful in the present invention includes those represented by the structure of Formula I:

(I)

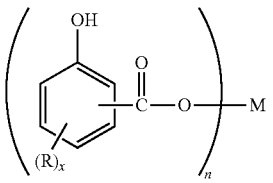

wherein M independently represents an alkaline earth metal or alkali metal; x is 1 or 2; n is 1 or 2 depending on the nature of M; each carboxylate group independently may be in the ortho, meta or para position, or mixtures thereof, with respect to the hydroxyl group; and each R independently represents a linear and/or branched $C_{26+}$ alkyl groups derived from one or more normal alpha olefins and may be in the ortho, meta or para position, or mixtures thereof, with respect to the hydroxyl group.

In another embodiment, a representative example of a suitable salt of a carboxylate-containing detergent that may be useful in the present invention includes those represented by the structure of Formula II:

(II)

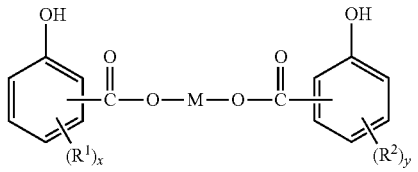

wherein M independently represents an alkaline earth metal; each carboxylate group independently may be in the ortho, meta or para position, or mixtures thereof, with respect to the hydroxyl group; each of $R^1$ and $R^2$ independently represents a linear and/or branched $C_{26+}$ alkyl groups derived from one or more normal alpha olefins and may be in the ortho, meta or para position, or mixtures thereof, with respect to the hydroxyl group, and x and y are independently 1 or 2.

In one embodiment, the salt is a neutral or overbased salt of an alkyl-substituted hydroxyaromatic carboxylic acid and is an alkaline earth salt (e.g., calcium or magnesium) of an alkyl-substituted hydroxyaromatic carboxylic acid. In one embodiment, the salt is a neutral or overbased salt of an alkyl-substituted hydroxyaromatic carboxylic acid and is an alkali metal salt (e.g., sodium or potassium) of an alkyl-substituted hydroxyaromatic carboxylic acid.

Some examples of suitable overbased salts of the foregoing alkyl-substituted hydroxyaromatic carboxylic acid include, for example, overbased metal salts having a TBN of greater than 100, for example between 100 and 650, between 100 and 450, or between 125 and 400. Suitable overbased salts of the foregoing alkyl-substituted hydroxyaromatic carboxylic acid may include high overbased or middle overbased detergents. For example, high overbased salts include, for example, those having a TBN of greater than 250, for example, between 250 and 450, between 300 and 400, or between 325 and 375; and middle overbased salts include, for example, those having a TBN between 100 and 250, for example, between 100 and 200, or between 125 and 175.

The process used to make the salt of an alkyl-substituted hydroxyaromatic carboxylic acid, wherein at least about 50% of the alkyl moiety of the alkyl-substituted hydroxyaromatic carboxylic acid comprises $C_{26+}$ alkyl groups derived from one or more normal alpha olefins, is not particularly limited and may be any such process known in the art. The process generally starts with the synthesis of the alkyl-substituted hydroxyaromatic carboxylic acid. This can be accomplished in any convenient manner, but in one embodiment is accomplished by alkylation of a hydroxyaromatic compound, preferably phenol, with an olefin or mixture of olefins comprising $C_{26+}$ normal alpha olefins, followed by carboxylation by means of e.g. the well known Kolbe-Schmitt reaction. In another embodiment the synthesis is accomplished by direct alkylation of a hydroxyaromatic carboxylic acid, preferably salicylic acid. Alkylation can be performed by any suitable means. In one preferred embodiment, a $C_{26+}$ normal alpha olefin is marketed by ChevronPhillips Chemical Company under the name Normal Alpha Olefin $C_{26}$ to $C_{28}$.

In one embodiment, the salt of an alkyl-substituted hydroxyaromatic carboxylic acid, wherein at least about 50% of the alkyl moiety of the alkyl-substituted hydroxyaromatic carboxylic acid comprises $C_{26+}$ alkyl groups derived from one or more normal alpha olefins, may be prepared by a process involving (a) reacting an alkyl-substituted hydroxyaromatic compound, wherein at least about 50% of the alkyl moiety of the alkyl-substituted hydroxyaromatic compound comprises $C_{26+}$ alkyl groups derived from one or more normal alpha olefins, such as an alkyl-substituted phenol (or alkylphenol), as described above, with an alkali metal base to produce an alkali metal alkyl-substituted phenate; (b) carboxylating the alkali metal alkyl-substituted phenate obtained in step (a) with a carboxylating agent, for example, carbon dioxide, to produce an alkali metal alkyl-substituted hydroxybenzoate; (c) acidifying the alkali metal alkyl-substituted hydroxybenzoate with an aqueous solution of an acid strong enough to produce an alkyl-substituted hydroxybenzoic acid; (d) neutralizing the alkyl-substituted hydroxybenzoic acid with a molar excess of an alkaline earth metal base, for example calcium hydroxide, and at least one solvent selected from the group consisting of aromatic hydrocarbons, aliphatic hydrocarbons; monoalcohols, and mixtures thereof to form an alkaline earth metal alkyl-substituted hydroxybenzoate; and (e) overbasing the alkaline earth metal alkyl-substituted hydroxybenzoate from step (d) with a molar excess of an alkaline earth metal base (for example, the same metal base as in step (d) or any other an alkaline earth metal base, e.g., lime and at least one acidic overbasing material (e.g., carbon dioxide and/or boric acid) in the presence of the at least one alkaline earth metal carboxylic acid salt from step (d) and at least one solvent selected from the group consisting of aromatic hydrocarbons, aliphatic hydrocarbons, monoalcohols, and mixtures thereof.

In one embodiment, the salt of an alkyl-substituted hydroxyaromatic carboxylic acid, wherein at least about 50% of the alkyl moiety of the alkyl-substituted hydroxyaromatic carboxylic acid comprises $C_{26+}$ alkyl groups derived from one or more normal alpha olefins, may be prepared by a process involving (a) reacting an alkyl-substituted hydroxyaromatic compound, wherein at least about 50% of the alkyl moiety of the alkyl-substituted hydroxyaromatic compound comprises $C_{26+}$ alkyl groups derived from one or more normal alpha olefins, such as an alkyl-substituted phenol (or alkylphenol), as described above, with an alkali metal base to produce an alkali metal alkyl-substituted phenate; (b) carboxylating the alkali metal alkyl-substituted phenate obtained in step (a) with a carboxylating agent, for example, carbon dioxide, to produce an alkali metal alkyl-substituted hydroxybenzoate; (c) acidifying the alkali metal alkyl-substituted hydroxybenzoate with an aqueous solution of an acid strong enough to produce an alkyl-substituted hydroxybenzoic acid; (d) neutralizing the alkyl-substituted hydroxybenzoic acid with a molar excess of an alkaline earth metal base, for example calcium hydroxide, and at least one solvent selected from the group consisting of aromatic hydrocarbons, aliphatic hydrocarbons; monoalcohols, and mixtures thereof to form an alkaline earth metal alkyl-substituted hydroxybenzoate; (e) mixing the alkaline earth metal alkyl-substituted hydroxybenzoate and alkaline earth metal base from step (d) with at least one carboxylic acid having from about one to four carbon atoms in the presence of a solvent selected from the group consisting of aromatic hydrocarbons, aliphatic hydrocarbons, monoalcohols, and mixtures thereof to form a mixture of alkaline earth metal alkyl-substituted hydroxybenzoate and at least one alkaline earth metal carboxylic acid salt; and (f) overbasing the alkaline earth metal alkyl-substituted hydroxybenzoate from step (e) with a molar excess of an alkaline earth metal base (for example, the same metal base as in step (d) or any other an alkaline earth metal base, e.g., lime and at least one acidic overbasing material (e.g., carbon dioxide and/or boric acid) in the presence of the at least one alkaline earth metal carboxylic acid salt from step (e) and at least one solvent selected from the group consisting of aromatic hydrocarbons, aliphatic hydrocarbons, monoalcohols, and mixtures thereof.

In another embodiment, the salt of an alkyl-substituted hydroxyaromatic carboxylic acid, wherein the alkyl moiety of the alkyl-substituted hydroxyaromatic carboxylic acid comprises $C_{26+}$ alkyl groups derived from one or more normal alpha olefins, may be prepared by the following steps:

A. Formation of the Metal Base Alkylphenate

In the first step, alkyl-substituted hydroxyaromatic compounds such as alkylphenols in which at least about 50% of the alkyl moiety of the alkyl-substituted hydroxyaromatic carboxylic acid comprises $C_{26+}$ alkyl groups derived from one or more normal alpha olefins are neutralized using an alkali metal base, preferably in the presence of a light solvent, such as toluene, xylene isomers, light alkylbenzene and the like, to form the metal base alkylphenate. In one embodiment, the solvent forms an azeotrope with water. In another embodiment, the solvent may also be a mono-alcohol such as 2-ethylhexanol. In this case, the 2-ethylhexanol is eliminated by distillation before carboxylation. The objective with the solvent is to facilitate the elimination of water.

The alkali metal bases that can be used for carrying out this step include the oxides or hydroxides of lithium, sodium or potassium. In one preferred embodiment, potassium hydroxide is used. In another preferred embodiment, sodium hydroxide is used.

An objective of this step is to have an alkyl-substituted phenate having less than about 2000 ppm, or less than about 1000 ppm or less than about 500 ppm of water. In this regard, the first step is carried out at a temperature high enough to eliminate water. In one embodiment, the product is put under a slight vacuum in order to require a lower reaction temperature.

In one embodiment, xylene is used as a solvent and the reaction conducted at a temperature between about 130° C. and about 155° C., under a reduced pressure of about 0.4 HPa to about 0.8 HPa.

The quantities of reagents used should preferably correspond to the following molar ratio ranges: metal base:alkylphenol from about 0.5:1 to about 1:1, and preferably from about 0.9:1 to about 1:1 and a solvent:alkylphenol (wt:wt) from about 1:1 to about 0.3:1 and preferably from about 0.7:1 to about 0.4:1.

B. Carboxylation

This carboxylation step is preferably conducted by bubbling carbon dioxide ($CO_2$) into the reaction medium originating from the preceding step and is continued until at least 50 mole % of the starting alkyl-substituted phenol has been converted to an alkyl-substituted hydroxyaromatic carboxylic acid (measured as hydroxyaromatic carboxylic acid by potentiometric determination).

In one embodiment, at least about 50 mole %, or about 75 mole %, or about 85 mole %, of the starting alkyl-substituted phenol is converted to alkyl-substituted hydroxylbenzoate using carbon dioxide at a temperature between about 110° C. and 200° C. under a pressure within the range of from about atmospheric to 15 bar ($15\times10^5$ Pa), preferably from 1 bar ($1\times10^5$ Pa) to 5 bar ($5\times10^5$ Pa), for a period between about 1 and 8 hours.

In the case of a potassium salt, the temperature can range between about 125° C. to about 165° C. or between about 130° C. to about 155° C., and the pressure is from about atmospheric to 15 bar ($15\times10^5$ Pa), or from about atmospheric to 4 bar ($4\times10^5$ Pa).

In the case of a sodium salt, the temperature can range between about 110° C. to about 155° C. or from about 120° C. to about 140° C., and the pressure from about 1 bar to 20 bar ($1\times10^5$ to $20\times10^5$ Pa), or from about 3 bar to about 15 bar ($3\times10^5$ to $15\times10^5$ Pa).

C. Acidification.

The objective of this step is to acidify the alkylhydroxybenzoate salt diluted in the solvent to give an alkyl-substituted hydroxyaromatic carboxylic acid. As one skilled in the art will readily appreciate, any acid stronger than the alkyl-substituted hydroxyaromatic carboxylic acid can be utilized. Typically, hydrochloric acid or aqueous sulfuric acid is employed.

The acidification is generally conducted with an H+ equivalent excess of acid versus potassium hydroxide of at least 5H+ equivalent %, preferably 10H+ equivalent % and more preferably 30H+ equivalent %, to complete the acidification.

In one embodiment, sulfuric acid is used. In general, the sulfuric acid is diluted with water to about 5 volume % to about 50 volume %. The quantity of sulfuric acid used versus hydroxybenzoate, on a per mole of hydroxybenzoate basis, is in one embodiment at least about 0.525 mole, or about 0.55 mole or about 0.65 mole of sulfuric acid.

The acidification reaction can be carried out under agitation or with any suitable mixing system at a temperature from about room temperature to 95° C. In one embodiment, the temperature can range from about 50° C. to about 80° C., over a period linked with the efficiency of the mixing. For example, when a stirred reactor is utilized and the period is from about 15 minutes to about 300 minutes, or from about 60 minutes to about 180 minutes. When a static mixer is utilized, the period may be shorter.

At the end of this period time, the agitation is stopped in order to allow good phase separation. After phase separation is complete, the organic phase is centrifugated to decrease the level of residual water and water-soluble impurities such as sulfuric acid and potassium sulfate. The water phase is treated as a waste material.

D. Neutralization

The alkyl-substituted hydroxyaromatic carboxylic acid from step C is neutralized with an alkali metal or alkaline earth metal base and at least one solvent selected from the group consisting of aromatic hydrocarbons, aliphatic hydrocarbons monoalcohols, and mixtures thereof to form an alkali metal alkaline earth metal alkyl-substituted hydroxylbenzoate.

E. Contact with Carboxylic Acid

Optionally, the alkali metal or alkaline earth metal alkyl-substituted hydroxylbenzoate and obtained in step D can contacted with at least one carboxylic acid having from about one to four carbon atoms.

F. Overbasing

Overbasing of the alkyl-substituted hydroxylbenzoate may be carried out by any method known by a person skilled in the art to produce overbased alkylhydroxybenzoates, see, for example, the method disclosed in U.S. Patent Application Publication No. 20070027043, the contents of which are incorporated by reference herein.

Generally, the amount of the at least one detergent comprising a salt of an alkyl-substituted hydroxyaromatic carboxylic acid, wherein the alkyl moiety of the alkyl-substituted hydroxyaromatic carboxylic acid comprises $C_{26+}$ alkyl groups derived from one or more normal alpha olefins, present in the trunk piston engine lubricating oil compositions can range from about 0.3 wt. % to about 15 wt. %, based on the total weight of the trunk piston engine lubricating oil composition.

The trunk piston engine lubricating oil compositions of the present invention will also contain one or more zinc dithiophosphates in an amount of about 0.02 to about 0.12 wt. % in terms of phosphorus content. In one embodiment, the trunk piston engine lubricating oil compositions of the present invention will also contain one or more zinc dithiophosphates in an amount of about 0.02 to about 0.06 wt. % in terms of phosphorus content.

The zinc dithiophosphates are typically zinc dihydrocarbyl dithiophosphates such as zinc dialkyl dithiophosphates, zinc diaryl dithiophosphates, zinc alkyl-aryl dithiophosphates and mixtures thereof. The dihydrocarbyl dithiophosphates may be prepared in accordance with known techniques by first forming a dihydrocarbyl dithiophosphoric acid (DDPA), usually by reacting one or more of alcohols and phenol compounds with $P_2S_5$ and then neutralizing the formed. DDPA with a compound of the zinc, such as an oxide, hydroxide or carbonate of zinc. In some embodiments, a DDPA may be made by reacting mixtures of primary and secondary alcohols with $P_2S_5$. In other embodiments, two or more zinc dihydrocarbyl dithiophosphoric acids can be prepared where the hydrocarbyl groups on one are entirely secondary in character and the hydrocarbyl groups on the others are entirely primary in character.

In some embodiments, oil soluble zinc dialkyl dithiophosphates may be produced from dialkyl dithiophosphoric acids represented by Formula III:

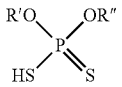

(III)

wherein each of R' and R" is independently linear or branched alkyl or linear or branched substituted alkyl. In some embodiments, the alkyl group has from about 3 to about 30 carbon atoms or from about 3 to about 8 carbon atoms.

The dialkyldithiophosphoric acids of formula I can be prepared by reacting alcohols R'OH and R"OH with $P_2S_5$ where R' and R" are as defined above. In some embodiments, R' and R" are the same. In other embodiments, R' and R" are different. In further embodiments, R'OH and R"OH react with $P_2S_5$ simultaneously. In still further embodiments, R'OH and R"OH react with $P_2S_5$ sequentially.

Mixtures of hydroxyl alkyl compounds may also be used. These hydroxyl alkyl compounds need not be monohydroxy alkyl compounds. In some embodiments, the dialkyldithiophosphoric acids is prepared from mono-, di-, tri-, tetra-, and other polyhydroxy alkyl compounds, or mixtures of two or more of the foregoing. In other embodiments, the zinc dialkyldithiophosphate derived from only primary alkyl alcohols is derived from a single primary alcohol. In further embodiments, that single primary alcohol is 2-ethylhexanol. In certain embodiments, the zinc dialkyldithiophosphate derived from only secondary alkyl alcohols. In further embodiments, that mixture of secondary alcohols is a mixture of 2-butanol and 4-methyl-2-pentanol.

The phosphorus pentasulfide reactant used in the dialkyl dithiophosphoric acid formation step may contain certain amounts of one or more of $P_2S_3$, $P_4S_3$, $P_4S_7$, or $P_4S_9$. Compositions as such may also contain minor amounts of free sulfur. In certain embodiments, the phosphorus pentasulfide reactant is substantially free of any of $P_2S_3$, $P_4S_3$, $P_4S_7$, or $P_4S_9$. In certain embodiments, the phosphorus pentasulfide reactant is substantially free of free sulfur.

The trunk piston engine lubricating oil compositions of the present invention can be prepared by any method known to a person of ordinary skill in the art for making trunk piston engine lubricating oils. The ingredients can be added in any order and in any manner. Any suitable mixing or dispersing equipment may be used for blending, mixing or solubilizing the ingredients. The blending, mixing or solubilizing may be carried out with a blender, an agitator, a disperser, a mixer (e.g., planetary mixers and double planetary mixers), a homogenizer (e.g., a Gaulin homogenizer or Rannie homogenizer), a mill (e.g., colloid mill, ball mill or sand mill) or any other mixing or dispersing equipment known in the art.

The trunk piston engine lubricating oil compositions of the present invention can have any total base number (TBN) that is suitable for use in trunk piston engines. In general, a trunk piston engine lubricating oil composition of the present invention can have a TBN of at least about 10, or at least about 12, or at least about 15, or at least about 20, or at least about 25. In one embodiment, a trunk piston engine lubricating oil composition of the present invention can have a TBN of about 20 to about 60. In another embodiment, a trunk piston engine lubricating oil composition of the present invention can have a TBN of about 30 to about 50.

The trunk piston engine lubricating oil compositions of the present invention can have any viscosity that is suitable for use in a trunk piston engine. Generally, a trunk piston engine lubricating oil composition of the present invention can have a viscosity ranging from about 5 to about 25 centistokes (cSt) at 100° C. In one embodiment, a trunk piston engine lubricating oil composition of the present invention can have a viscosity ranging from about 10 to about 20 cSt at 100° C. The viscosity of the trunk piston engine lubricating oil composition can be measured by any suitable method, e.g., ASTM D445. In one embodiment, the trunk piston engine lubricating oil compositions of the present invention are monograde trunk piston engine lubricating oil compositions. In another embodiment, the trunk piston engine lubricating oil compositions of the present invention are SAE 30 or 40 monograde trunk piston engine lubricating oil compositions. The definitions of SAE 30 and SAE 40 used in this invention are given in the SAE International standard J300 revised 2009-01.

In one embodiment, the trunk piston engine lubricating oil compositions of the present invention contain less than about 2 wt. % of a polyalkylene succinimide. In one embodiment, the trunk piston engine lubricating oil compositions of the present invention contain less than about 2 wt. % of a polyisobutenyl succinimide. In one embodiment, the trunk piston engine lubricating oil compositions of the present invention contain less than about 2 wt. % of a polyalkenyl bissuccinimide. In one embodiment, the trunk piston engine lubricating oil compositions of the present invention contain less than about 2 wt. % of a polyisobutenyl bissuccinimide.

In one embodiment, the trunk piston engine lubricating oil compositions of the present invention contain a viscosity index improver.

In one preferred embodiment, the trunk piston engine lubricating oil compositions of the present invention reduce black sludge (or black sludge deposit) formation in an engine such as an engine using a heavy fuel oil, e.g., an asphaltene-containing heavy fuel oil, by at least about 5%, preferably at least about 10%, more preferably at least about 20% and most preferably at least about 30% when compared to a trunk piston engine lubricating oil composition containing a major amount of an oil of lubricating viscosity, a minor amount of a salt of an alkyl-substituted hydroxyaromatic carboxylic acid, wherein the alkyl moiety of the alkyl-substituted hydroxyaromatic carboxylic acid is $C_{20}$ to $C_{28}$ alkyl groups derived from one or more normal alpha olefins; and one or more zinc hydrocarbyl dithiophosphates in an amount of about 0.02 to about 0.12 wt. % in terms of phosphorus content.

The trunk piston engine lubricating oil compositions of the present invention may also contain conventional trunk piston engine lubricating oil composition additives that can impart or improve any desirable property of the finished trunk piston engine lubricating oil composition in which these additives are dispersed or dissolved. Any additive known to a person of ordinary skill in the art may be used in the trunk piston engine lubricating oil compositions disclosed herein. Some suitable additives have been described in Mortier et al., "Chemistry and Technology of Lubricants," 2nd Edition, London, Springer, (1996); and Leslie R. Rudnick, "Lubricant Additives: Chemistry and Applications," New York, Marcel Dekker (2003), both of which are incorporated herein by reference. For example, the trunk piston engine lubricating oil compositions can be blended with antioxidants, ashless dispersants, anti-wear agents, rust inhibitors, dehazing agents, demulsifying agents, metal deactivating agents, friction modifiers, pour point depressants, antifoaming agents, co-solvents, package compatibilisers, corrosion-inhibitors, dyes, extreme pressure agents and the like and mixtures thereof. A variety of the additives are known and commercially available. These additives, or their analogous compounds, can be employed for the preparation of the trunk piston engine lubricating oil compositions of the invention by the usual blending procedures.

In general, the concentration of each of the additives in the lubricating oil composition, when used, may range from about 0.001 wt. % to about 20 wt. %, from about 0.01 wt. % to about 15 wt. %, or from about 0.1 wt. % to about 10 wt. %, based on the total weight of the lubricating oil composition. Further, the total amount of the additives in the lubricating oil composition may range from about 0.001 wt. % to about 30 wt. %, from about 0.01 wt. % to about 25 wt. %, or from about 0.1 wt. % to about 20 wt. %, based on the total weight of the lubricating oil composition.

The lubricating oil composition disclosed herein can contain one or more antioxidants that can reduce or prevent the oxidation of the base oil. Any antioxidant known by a person of ordinary skill in the art may be used in the lubricating oil composition. Non-limiting examples of suitable antioxidants include amine-based antioxidants (e.g., alkyl diphenylamines such as bis-nonylated diphenylamine, bis-octylated diphenylamine, and octylated/butylated diphenylamine, phenyl-α-naphthylamine, alkyl or arylalkyl substituted phenyl-α-naphthylamine, alkylated p-phenylene diamines, tetramethyldiaminodiphenylamine and the like), phenolic antioxidants (e.g., 2-tert-butylphenol, 4-methyl-2,6-di-tert-butylphenol, 2,4,6-tri-tert-butylphenol, 2,6-di-tert-butyl-p-cresol, 2,6-di-tert-butylphenol, 4,4'-methylenebis-(2,6-di-tert-butylphenol), 4,4'-thiobis(6-di-tert-butyl-o-cresol) and the like), sulfur-based antioxidants (e.g., dilauryl-3,3'-thiodipropionate, sulfurized phenolic antioxidants and the like), phosphorous-based antioxidants (e.g., phosphites and the like), zinc dithiophosphate, oil-soluble copper compounds and combinations thereof.

In one embodiment, the trunk piston engine lubricating oil compositions of the present invention contain less than about 1 wt. % of an oxidation inhibitor. In one embodiment, the trunk piston engine lubricating oil compositions of the present invention contain less than about 0.5 wt. % of an oxidation inhibitor.

The lubricating oil composition disclosed herein can contain one or more ashless dispersant compounds to maintain in suspension insoluble materials resulting from oxidation during use, thus preventing sludge flocculation and precipitation or deposition on metal parts. Dispersants may also function to reduce changes in lubricating oil viscosity by preventing the growth of large contaminant particles in the lubricant. Any dispersant known by a person of ordinary skill in the art may be used in the lubricating oil composition. An ashless dispersant generally comprises an oil soluble polymeric hydrocarbon backbone having functional groups that are capable of associating with particles to be dispersed.

In one embodiment, an ashless dispersant is one or more basic nitrogen-containing ashless dispersants. Nitrogen-containing basic ashless (metal-free) dispersants contribute to the base number or TBN of a lubricating oil composition to which they are added, without introducing additional sulfated ash. Basic nitrogen-containing ashless dispersants useful in this invention include hydrocarbyl succinimides; hydrocarbyl succinamides; mixed ester/amides of hydrocarbyl-substituted succinic acids formed by reacting a hydrocarbyl-substituted succinic acylating agent stepwise or with a mixture of alcohols and amines, and/or with amino alcohols; Mannich condensation products of hydrocarbyl-substituted phenols, formaldehyde and polyamines; and amine dispersants formed by reacting high molecular weight aliphatic or alicyclic halides with amines, such as polyalkylene polyamines. Mixtures of such dispersants can also be used.

Representative examples of ashless dispersants include, but are not limited to, amines, alcohols, amides, or ester polar moieties attached to the polymer backbones via bridging groups. An ashless dispersant may be, for example, selected from oil soluble salts, esters, amino-esters, amides, imides, and oxazolines of long chain hydrocarbon substituted mono and dicarboxylic acids or their anhydrides; thiocarboxylate derivatives of long chain hydrocarbons, long chain aliphatic hydrocarbons having a polyamine attached directly thereto; and Mannich condensation products formed by condensing a long chain substituted phenol with formaldehyde and polyalkylene polyamine.

Carboxylic dispersants are reaction products of carboxylic acylating agents (acids, anhydrides, esters, etc.) comprising at least about 34 and preferably at least about 54 carbon atoms with nitrogen containing compounds (such as amines), organic hydroxy compounds (such as aliphatic compounds including monohydric and polyhydric alcohols, or aromatic compounds including phenols and naphthols), and/or basic inorganic materials. These reaction products include imides, amides, and esters.

Succinimide dispersants are a type of carboxylic dispersant. They are produced by reacting hydrocarbyl-substituted succinic acylating agent with organic hydroxy compounds, or with amines comprising at least one hydrogen atom attached to a nitrogen atom, or with a mixture of the hydroxy compounds and amines. The term "succinic acylating agent" refers to a hydrocarbon-substituted succinic acid or a succinic acid-producing compound, the latter encompasses the acid itself. Such materials typically include hydrocarbyl-substituted succinic acids, anhydrides, esters (including half esters) and halides.

Succinic-based dispersants have a wide variety of chemical structures. One class of succinic-based dispersants may be represented by the formula:

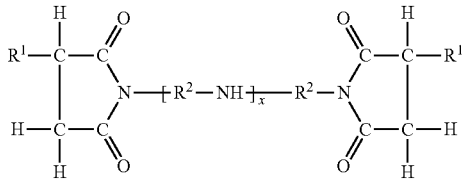

wherein each $R^1$ is independently a hydrocarbyl group, such as a polyolefin-derived group. Typically the hydrocarbyl group is an alkyl group, such as a polyisobutyl group. Alternatively expressed, the $R^1$ groups can contain about 40 to about 500 carbon atoms, and these atoms may be present in aliphatic forms. $R^2$ is an alkylene group, commonly an ethylene ($C_2H_4$) group. Examples of succinimide dispersants include those described in, for example, U.S. Pat. Nos. 3,172,892, 4,234,435 and 6,165,235.

The polyalkenes from which the substituent groups are derived are typically homopolymers and interpolymers of polymerizable olefin monomers of 2 to about 16 carbon atoms, and usually 2 to 6 carbon atoms. The amines which are reacted with the succinic acylating agents to form the carboxylic dispersant composition can be monoamines or polyamines.

Succinimide dispersants are referred to as such since they normally contain nitrogen largely in the form of imide functionality, although the amide functionality may be in the form of amine salts, amides, imidazolines as well as mixtures thereof. To prepare a succinimide dispersant, one or more succinic acid-producing compounds and one or more amines are heated and typically water is removed, optionally in the presence of a substantially inert organic liquid solvent/diluent. The reaction temperature can range from about 80° C. up to the decomposition temperature of the mixture or the product, which typically falls between about 100° C. to about 300° C. Additional details and examples of procedures for preparing the succinimide dispersants of the present invention include those described in, for example, U.S. Pat. Nos. 3,172,892, 3,219,666, 3,272,746, 4,234,435, 6,165,235 and 6,440,905.

Suitable ashless dispersants may also include amine dispersants, which are reaction products of relatively high molecular weight aliphatic halides and amines, preferably polyalkylene polyamines. Examples of such amine dispersants include those described in, for example, U.S. Pat. Nos. 3,275,554, 3,438,757, 3,454,555 and 3,565,804.

Suitable ashless dispersants may further include "Mannich dispersants," which are reaction products of alkyl phenols in which the alkyl group contains at least about 30 carbon atoms with aldehydes (especially formaldehyde) and amines (especially polyalkylene polyamines). Examples of such dispersants include those described in, for example, U.S. Pat. Nos. 3,036,003, 3,586,629, 3,591,598 and 3,980,569.

Suitable ashless dispersants may also be post-treated ashless dispersants such as post-treated succinimides, e.g., post-treatment processes involving borate or ethylene carbonate as disclosed in, for example, U.S. Pat. Nos. 4,612,132 and 4,746,446; and the like as well as other post-treatment processes. The carbonate-treated alkenyl succinimide is a polybutene succinimide derived from polybutenes having a molecular weight of about 450 to about 3000, preferably from about 900 to about 2500, more preferably from about 1300 to about 2400, and most preferably from about 2000 to about 2400, as well as mixtures of these molecular weights. Preferably, it is prepared by reacting, under reactive conditions, a mixture of a polybutene succinic acid derivative, an unsaturated acidic reagent copolymer of an unsaturated acidic reagent and an olefin, and a polyamine, such as disclosed in U.S. Pat. No. 5,716,912, the contents of which are incorporated herein by reference.

Suitable ashless dispersants may also be polymeric, which are interpolymers of oil-solubilizing monomers such as decyl methacrylate, vinyl decyl ether and high molecular weight olefins with monomers containing polar substitutes. Examples of polymeric dispersants include those described in, for example, U.S. Pat. Nos. 3,329,658; 3,449,250 and 3,666,730.

The lubricating oil composition disclosed herein can contain an additional detergent other than the detergents of the invention. Any compound or a mixture of compounds that can reduce or slow the build up of deposits can be used as a detergent. Non-limiting examples of suitable metal detergent include sulfurized or unsulfurized alkyl or alkenyl phenates, alkyl or alkenyl aromatic sulfonates, borated sulfonates, sulfurized or unsulfurized metal salts of multi-hydroxy alkyl or alkenyl aromatic compounds, alkyl or alkenyl hydroxy aromatic sulfonates, sulfurized or unsulfurized alkyl or alkenyl naphthenates, metal salts of alkanoic acids, metal salts of an alkyl or alkenyl multiacid, and chemical and physical mixtures thereof. Other non-limiting examples of suitable metal detergents include metal sulfonates, salicylates, phosphonates, thiophosphonates and combinations thereof. The metal can be any metal suitable for making sulfonate, salicylate or phosphonate detergents. Non-limiting examples of suitable metals include alkali metals, alkaline metals and transition metals. In some embodiments, the metal is Ca, Mg, Ba, K, Na, Li or the like.

In some embodiments, the amount of the detergent is from about 0.001 wt. % to about 25 wt. %, from about 0.05 wt. % to about 20 wt. %, or from about 0.1 wt. % to about 15 wt. %, based on the total weight of the lubricating oil composition. Some suitable detergents have been described in Mortier et al., "Chemistry and Technology of Lubricants," 2nd Edition, London, Springer, Chapter 3, pages 75-85 (1996); and Leslie R. Rudnick, "Lubricant Additives: Chemistry and Applications," New York, Marcel Dekker, Chapter 4, pages 113-136 (2003), both of which are incorporated herein by reference.

The lubricating oil composition disclosed herein can contain one or more friction modifiers that can lower the friction between moving parts. Any friction modifier known by a person of ordinary skill in the art may be used in the lubricating oil composition. Non-limiting examples of suitable friction modifiers include fatty carboxylic acids; derivatives (e.g., alcohol, esters, borated esters, amides, metal salts and the like) of fatty carboxylic acid; mono-, di- or tri-alkyl substituted phosphoric acids or phosphonic acids; derivatives (e.g., esters, amides, metal salts and the like) of mono-, di- or tri-alkyl substituted phosphoric acids or phosphonic acids; mono-, di- or tri-alkyl substituted amines; mono- or di-alkyl substituted amides and combinations thereof. In some embodiments examples of friction modifiers include, but are not limited to, alkoxylated fatty amines; borated fatty epoxides; fatty phosphites, fatty epoxides, fatty amines, borated alkoxylated fatty amines, metal salts of fatty acids, fatty acid amides, glycerol esters, borated glycerol esters; and fatty imidazolines as disclosed in U.S. Pat. No. 6,372,696, the contents of which are incorporated by reference herein; friction modifiers obtained from a reaction product of a $C_4$ to $C_{75}$, or a $C_6$ to $C_{24}$, or a $C_6$ to $C_{20}$ fatty acid ester and a nitrogen-containing compound selected from the group consisting of ammonia, and an alkanolamine and the like and mixtures thereof. The amount of the friction modifier may vary from about 0.01 wt. % to about 10 wt. %, from about 0.05 wt. % to about 5 wt. %, or from about 0.1 wt. % to about 3 wt. %, based on the total weight of the lubricating oil composition. Some suitable friction modifiers have been described in Mortier et al., "Chemistry and Technology of Lubricants," 2nd Edition, London, Springer, Chapter 6, pages 183-187 (1996); and Leslie R. Rudnick, "Lubricant Additives: Chemistry and Applications," New York, Marcel Dekker, Chapters 6 and 7, pages 171-222 (2003), both of which are incorporated herein by reference.

The lubricating oil composition disclosed herein can contain one or more anti-wear agents other than the one or more zinc dithiophosphates that can reduce friction and excessive wear. Non-limiting examples of suitable anti-wear agents include metal (e.g., Pb, Sb, Mo and the like) salts of dithiophosphates, metal (e.g., Zn, Pb, Sb, Mo and the like) salts of dithiocarbamates, metal (e.g., Zn, Pb, Sb and the like) salts of fatty acids, boron compounds, phosphate esters, phosphite esters, amine salts of phosphoric acid esters or thiophosphoric acid esters, reaction products of dicyclopentadiene and thiophosphoric acids and combinations thereof. The amount of the anti-wear agent may vary from about 0.01 wt. % to about 5 wt. %, from about 0.05 wt. % to about 3 wt. %, or from about 0.1 wt. % to about 1 wt. %, based on the total weight of the lubricating oil composition. Some suitable anti-wear agents have been described in Leslie R. Rudnick, "Lubricant Additives: Chemistry and Applications," New York, Marcel Dekker, Chapter 8, pages 223-258 (2003), which is incorporated herein by reference.

The lubricating oil composition disclosed herein can contain one or more foam inhibitors or anti-foam agents that can break up foams in oils. Any foam inhibitor or anti-foam agents known by a person of ordinary skill in the art may be used in the lubricating oil composition. Non-limiting examples of suitable foam inhibitors or anti-foam agents include silicone oils or polydimethylsiloxanes, fluorosilicones, alkoxylated aliphatic acids, polyethers (e.g., polyethylene glycols), branched polyvinyl ethers, alkyl acrylate polymers, alkyl methacrylate polymers, polyalkoxyamines and combinations thereof. In some embodiments, the foam inhibitors or anti-foam agents comprises glycerol monostearate, polyglycol palmitate, a trialkyl monothiophosphate, an ester of sulfonated ricinoleic acid, benzoylacetone, methyl salicylate, glycerol monooleate, or glycerol dioleate. The amount of the foam inhibitors or anti-foam agents may vary from about 0.001 wt. % to about 5 wt. %, from about 0.01 wt. % to about 3 wt. %, or from about 0.02 wt. % to about 1 wt. %, based on the total weight of the lubricating oil composition. Some suitable foam inhibitors or anti-foam agents have been described in Mortier et al., "Chemistry and Technology of Lubricants," 2nd Edition, London, Springer, Chapter 6, pages 190-193 (1996), which is incorporated herein by reference.

The lubricating oil composition disclosed herein can contain one or more pour point depressants that can lower the pour point of the lubricating oil composition. Any pour point depressant known by a person of ordinary skill in the art may be used in the lubricating oil composition. Non-limiting examples of suitable pour point depressants include polymethacrylates, alkyl acrylate polymers, alkyl methacrylate polymers, di(tetra-paraffin phenol)phthalate, condensates of tetra-paraffin phenol, condensates of a chlorinated paraffin with naphthalene and combinations thereof. In some embodiments, the pour point depressant comprises an ethylene-vinyl acetate copolymer, a condensate of chlorinated paraffin and phenol, polyalkyl styrene or the like. The amount of the pour point depressant may vary from about 0.01 wt. % to about 10 wt. %, from about 0.05 wt. % to about 5 wt. %, or from about 0.1 wt. % to about 3 wt. %, based on the total weight of the lubricating oil composition. Some suitable pour point depressants have been described in Mortier et al., "Chemistry and Technology of Lubricants," 2nd Edition, London, Springer, Chapter 6, pages 187-189 (1996); and Leslie R. Rudnick, "Lubricant Additives: Chemistry and Applications," New York, Marcel Dekker, Chapter 11, pages 329-354 (2003), both of which are incorporated herein by reference.

The lubricating oil composition disclosed herein can contain one or more demulsifiers that can promote oil-water separation in lubricating oil compositions that are exposed to water or steam. Any demulsifier known by a person of ordinary skill in the art may be used in the lubricating oil composition. Non-limiting examples of suitable demulsifiers include anionic surfactants (e.g., alkyl-naphthalene sulfonates, alkyl benzene sulfonates and the like), nonionic alkoxylated alkyl phenol resins, polymers of alkylene oxides (e.g., polyethylene oxide, polypropylene oxide, block copolymers of ethylene oxide, propylene oxide and the like), esters of oil soluble acids, polyoxyethylene sorbitan ester and combinations thereof. The amount of the demulsifier may vary from about 0.01 wt. % to about 10 wt. %, from about 0.05 wt. % to about 5 wt. %, or from about 0.1 wt. % to about 3 wt. %, based on the total weight of the lubricating oil composition. Some suitable demulsifiers have been described in Mortier et al., "Chemistry and Technology of Lubricants," 2nd Edition, London, Springer, Chapter 6, pages 190-193 (1996), which is incorporated herein by reference.

The lubricating oil composition disclosed herein can contain one or more corrosion inhibitors that can reduce corrosion. Any corrosion inhibitor known by a person of ordinary skill in the art may be used in the lubricating oil composition. Non-limiting examples of suitable corrosion inhibitor include half esters or amides of dodecylsuccinic acid, phosphate esters, thiophosphates, alkyl imidazolines, sarcosines and combinations thereof. The amount of the corrosion inhibitor may vary from about 0.01 wt. % to about 5 wt. %, from about 0.05 wt. % to about 3 wt. %, or from about 0.1 wt. % to about 1 wt. %, based on the total weight of the lubricating oil composition. Some suitable corrosion inhibitors have been described in Mortier et al., "Chemistry and Technology of Lubricants," 2nd Edition, London, Springer, Chapter 6, pages 193-196 (1996), which is incorporated herein by reference.

The lubricating oil composition disclosed herein can contain one or more extreme pressure (EP) agents that can prevent sliding metal surfaces from seizing under conditions of extreme pressure. Any extreme pressure agent known by a person of ordinary skill in the art may be used in the lubricating oil composition. Generally, the extreme pressure agent is a compound that can combine chemically with a Metal to form a surface film that prevents the welding of asperities in opposing metal surfaces under high loads. Non-limiting examples of suitable extreme pressure agents include sulfurized animal or vegetable fats or oils, sulfurized animal or vegetable fatty acid esters, fully or partially esterified esters of trivalent or pentavalent acids of phosphorus, sulfurized olefins, dihydrocarbyl polysulfides, sulfurized Diels-Alder adducts, sulfurized dicyclopentadiene, sulfurized or co-sulfurized mixtures of fatty acid esters and monounsaturated olefins, co-sulfurized blends of fatty acid, fatty acid ester and alpha-olefin, functionally-substituted dihydrocarbyl polysulfides, thia-aldehydes, thia-ketones, epithio compounds, sulfur-containing acetal derivatives, co-sulfurized blends of terpene and acyclic olefins, and polysulfide olefin products, amine salts of phosphoric acid esters or thiophosphoric acid esters and combinations thereof. The amount of the extreme pressure agent may vary from about 0.01 wt. % to about 5 wt. %, from about 0.05 wt. % to about 3 wt. %, or from about 0.1 wt. % to about 1 wt. %, based on the total weight of the lubricating oil composition. Some suitable extreme pressure agents have been described in Leslie R. Rudnick, "Lubricant Additives: Chemistry and Applications," New York, Marcel Dekker, Chapter 8, pages 223-258 (2003), which is incorporated herein by reference.

The lubricating oil composition disclosed herein can contain one or more rust inhibitors that can inhibit the corrosion of ferrous metal surfaces. Any rust inhibitor known by a person of ordinary skill in the art may be used in the lubricating oil composition. Non-limiting examples of suitable rust inhibitors include nonionic polyoxyalkylene agents, e.g., polyoxyethylene lauryl ether, polyoxyethylene higher alcohol ether, polyoxyethylene nonylphenyl ether, polyoxyethylene octylphenyl ether, polyoxyethylene octyl stearyl ether, polyoxyethylene oleyl ether, polyoxyethylene sorbitol monostearate, polyoxyethylene sorbitol monooleate, and polyethylene glycol monooleate; stearic acid and other fatty acids; dicarboxylic acids; metal soaps; fatty acid amine salts; metal salts of heavy sulfonic acid; partial carboxylic acid ester of polyhydric alcohol; phosphoric esters; (short-chain) alkenyl succinic acids; partial esters thereof and nitrogen-containing derivatives thereof; synthetic alkarylsulfonates, e.g., metal dinonylnaphthalene sulfonates; and the like and mixtures thereof. The amount of the rust inhibitor may vary from about 0.01 wt. % to about 10 wt. %, from about 0.05 wt. % to about 5 wt. %, or from about 0.1 wt. % to about 3 wt. %, based on the total weight of the lubricating oil composition.

The lubricating oil composition disclosed herein can contain one or more multifunctional additives. Non-limiting examples of suitable multifunctional additives include sulfurized oxymolybdenum dithiocarbamate, sulfurized oxymolybdenum organophosphorodithioate, oxymolybdenum monoglyceride, oxymolybdenum diethylate amide, amine-molybdenum complex compound, and sulfur-containing molybdenum complex compound.

The lubricating oil composition disclosed herein can contain one or more metal deactivators. Non-limiting examples of suitable metal deactivators include disalicylidene propylenediamine, triazole derivatives, thiadiazole derivatives, and mercaptobenzimidazoles.

If desired, the lubricant additives may be provided as an additive package or concentrate in which the additives are incorporated into a substantially inert, normally liquid organic diluent such as, for example, mineral oil, naphtha, benzene, toluene or xylene to form an additive concentrate. These concentrates usually contain from about 20% to about 80% by weight of such diluent. Typically, a neutral oil having a viscosity of about 4 to about 8.5 cSt at 100° C. and preferably about 4 to about 6 cSt at 100° C. will be used as the diluent, though synthetic oils, as well as other organic liquids which are compatible with the additives and finished lubricating oil can also be used. The additive package will typically contain one or more of the various additives, referred to above, in the desired amounts and ratios to facilitate direct combination with the requisite amount of the oil of lubricating viscosity.

The trunk piston engine lubricating oil compositions of the present invention may be suitable for use in a 4-stroke trunk piston engine having an engine speed of about 200 to about 2,000 rotations per minute (rpm), e.g., about 400 to about 1,000 rpm, and a brake horse-power (BHP) per cylinder of about 50 to about 5,000, preferably about 100 to about 3,000 and most preferably from about 100 to about 2,000. Engines used for auxiliary power generation applications or in land-based power generation applications are also suitable.

The following non-limiting examples are illustrative of the present invention.

Comparative Example A

Preparation of 150 TBN Calcium $C_{20}$ to $C_{28}$ Alkyl-Substituted Hydroxybenzoate Step A)—Formation of the Alkali Metal Base Alkylphenate.

An alkyphenol (1500 g), prepared from linear $C_{20}$-$C_{28}$ olefin containing $C_{20}$ at 35%, $C_{22}$ at 30% $C_{24}$ at 16% $C_{26}$ at 10% and $C_{28}$ at 6%, the reminder being $C_{18}$ and $C_{30}$, of average molecular weight of 405 g/mol estimated by gas chromatography (GC) and high-performance liquid chromatography (HPLC) was charged together with xylene (750 g), a 45% solution of potassium hydroxide (KOH) in water (435 g) and a silicon antifoam agent (0.2 g) in a 3 neck round bottom flask equipped with a Dean-Stark distillation apparatus. The mixture was heated at 135° C. at reduced pressure (450 mmHg) for 6 hours during which xylene and water were continuously distilled with xylene recycled back to the flask.

Step B)—Carboxylation.

The reactor containing the alkali metal alkylphenate in xylene from step A) was allowed to cool and the mixture was left overnight under nitrogen. The next day, the reactor was heated to 140° C. and pressurized with $CO_2$ at 3 bar and maintained under these conditions for 4 hours. At the end of this period, the content of the reactor was allowed to cool down to recover the potassium alkyl hydroxybenzoate in xylene. Next, the potassium alkyl hydroxybenzoate (1200 g) was introduced in a round bottom flask followed by xylene (722 g) and the mixture was heated to 80° C. A 10% solution of sulfuric acid (1069 g) was introduced slowly under stirring and the mixture was held at 70° C. for 30 minutes. The mixture was then transferred to a separating funnel and allowed to settle for 2 hours. After separation, the top layer containing the alkylhydroxybenzoic acid in xylene was recovered. The alkylhydroxybenzoic acid had an acidity measured by potentiometry of 41.8 mgKOH/g and a xylene content of 58%.

Step C)—Overbasing.

A slurry of 127.8 g of slaked lime in 153.3 g of methanol and 336.3 of xylene was prepared and introduced into a reactor. Then, 1663.3 g (1.24 eq) of the alkylhydroxybenzoic acid of step B) was loaded into the reactor and the temperature kept at 40° C. Once the alkylhydroxybenzoic acid was added, 12 g of a (50/50) mixture of acetic and formic acid was introduced leading to a slight temperature increase to 43° C. After cooling down to 30° C., $CO_2$ (27.2 g) was introduced in the reactor slowly while the temperature increased from 30 to 40° C. The reaction yielded a calcium alkylhydroxybenzoate overbased with calcium carbonate.

Step D)—Predistillation, Centrifugation, and Final Distillation.

The mixture contained within the reactor was taken to a temperature of 128° C. This procedure removed methanol, water and a portion of the xylene. Next, a base oil (204.2 g) was added to the mixture. The mixture was then centrifuged in a lab centrifuge to remove unreacted lime and other solids.

Finally, the mixture was heated at 170° C. under vacuum (15 mbar) to remove any remaining xylene and to obtain an oil concentrate of an overbased calcium alkyl-substituted hydroxybenzoate detergent containing 5.81 wt. % Ca and having a TBN of 162.7.

Comparative Example B

Preparation of 350 TBN Calcium $C_{20}$ to $C_{28}$ Alkyl-Substituted Hydroxybenzoate Step A)—Formation of the Alkali Metal Base Alkylphenate.

An alkyphenol (1500 g), prepared from linear $C_{20}$-$C_{28}$ olefin containing $C_{20}$ at 35%, $C_{22}$ at 30% $C_{24}$ at 16% $C_{26}$ at 10% and $C_{28}$ at 6%, the reminder being $C_{18}$ and $C_{30}$, of average molecular weight of 405 g/mol estimated by GC and HPLC was charged together with xylene (750 g), a 45% solution of KOH in water (435 g) and a silicon antifoam agent (0.2 g) in a 3 neck round bottom flask equipped with a Dean-Stark distillation apparatus. The mixture was heated at 135° C. at reduced pressure (450 mmHg) for 6 hours during which xylene and water were continuously distilled with xylene recycled back to the flask.

Step B)—Carboxylation.

The reactor containing the alkali metal alkylphenate in xylene from step A) was allowed to cool and the mixture was left overnight under nitrogen. The next day, the reactor was heated to 140° C. and pressurized with $CO_2$ at 3 bar and maintained under these conditions for 4 hours. At the end of this period, the content of the reactor was allowed to cool down to recover the potassium alkyl hydroxybenzoate in xylene. Next, the potassium alkyl hydroxybenzoate (1200 g) was introduced in a round bottom flask followed by xylene (722 g) and the mixture was heated to 80° C. A 10% solution of sulfuric acid (1069 g) was introduced slowly under stirring and the mixture was held at 70° C. for 30 minutes. The mixture was then transferred to a separating funnel and allowed to settle for 2 hours. After separation, the top layer containing the alkylhydroxybenzoic acid in xylene was recovered. The alkylhydroxybenzoic acid had an acidity measured by potentiometry of 41.8 mgKOH/g and a xylene content of 58%.

Step C)—Overbasing.

A slurry of 314.9 g of slaked lime in 207.7 g of methanol and 533.5 of xylene was prepared and introduced into a reactor. Then 1389.9 g (1.03 eq) of the alkylhydroxybenzoic acid of step B) was loaded into the reactor and the temperature was held at 40° C. Once the alkylhydroxybenzoic acid was added, 16.1 g of a (50/50) mixture of acetic and formic acid was introduced leading to a slight temperature increase to 43° C. After cooling down to 38° C., $CO_2$ (105.5 g) was introduced in the reactor slowly while the temperature increased from 38 to 50° C. Next, another slurry of 59.9 g of slaked lime in 39.6 g of methanol and 335.7 g of xylene was prepared and introduced into the reactor. The reactor was then charged with 70.6 g of $CO_2$ while the temperature increased up from 50° C. to 60° C. The reaction yielded a calcium alkylhydroxybenzoate overbased with calcium carbonate.

Step D)—Predistillation, Centrifugation, and Final Distillation.

The mixture contained within the reactor was taken to a temperature of 128° C. This procedure removed methanol, water and a portion of the xylene. Next, a base oil (347.4 g) was added to the mixture. The mixture was then centrifuged in a lab centrifuge to remove unreacted lime and other solids. Finally, the mixture was heated at 170° C. under vacuum (15 mbar) to remove any remaining xylene and to obtain an oil concentrate of an overbased calcium alkyl-substituted hydroxybenzoate detergent containing 12.16 wt. % Ca and having a TBN of 340.5.

Example 1

Preparation of a 150 TBN $C_{26}$ to $C_{28}$ Calcium Alkyl-Substituted Hydroxybenzoate Step A)—Formation of the Alkali Metal Base Alkylphenate.

An alkyphenol (1500 g), prepared from a linear $C_{26}$-$C_{28}$ normal alpha olefin containing predominantly $C_{26}$ at 58% and $C_{28}$ at 36%, the reminder being $C_{24}$ and $C_{30}$, of average molecular weight of 480 g/mol estimated by GC and HPLC was, charged together with xylene (750 g), a 45% solution of KOH in water (367 g) and 0.2 g of silicon antifoam agent in a 3 neck round bottom flask equipped with a Dean-Stark distillation apparatus. The mixture was heated at 135° C. at reduce pressure (450 mmHg) for 6 hours during which xylene and water are continuously distilled with xylene recycled back to the flask.

Step B)—Carboxylation.

The reactor containing the alkali metal alkylphenate in xylene from step A) was allowed to cool and the mixture was left overnight under nitrogen. The next day, the reactor was heated to 140° C. and pressurized with $CO_2$ at 3 bar and maintained under these conditions for 4 hours. At the end of this period, the content of the reactor was allowed to cool down to recover the potassium alkyl hydroxybenzoate in xylene. Next, the potassium alkyl hydroxybenzoate (1200 g) was introduced in a round bottom flask followed by xylene (722 g) and the mixture was heated to 80° C. A 10% solution of sulfuric acid (1069 g) was introduced slowly under stirring and the mixture was held at 70° C. for 30 minutes. The mixture was then transferred to a separating funnel and allowed to settle for 2 hours. After separation, the top layer containing the alkylhydroxybenzoic acid in xylene was recovered. The alkylhydroxybenzoic acid had an acidity measured by potentiometry of 36.2 mgKOH/g and a xylene content of 55.1%.

Step C)—Overbasing.

A slurry of 127.8 g of slaked lime in 153.3 g of methanol and 336.3 of xylene was prepared and introduced into a reactor. Then, 1920.6 g (1.24 eq) of the alkylhydroxybenzoic of step B) was loaded into the reactor and the temperature kept at 40° C. Once the alkylhydroxybenzoic acid was added, 12 g of a (50/50) mixture of acetic and formic acid was introduced leading to a slight temperature increase to 43° C. After cooling down to 30° C., $CO_2$ (27.2 g) was introduced in the reactor slowly while the temperature increased from 30 to 40° C. The reaction yielded a calcium alkylhydroxybenzoate overbased with calcium carbonate.

Step D)—Predistillation, Centrifugation, and Final Distillation.

The mixture contained within the reactor was taken to a temperature of 128° C. This procedure removed methanol, water and a portion of the xylene. Next; a base oil (204.2 g) was added to the mixture. The mixture was then centrifuged in a lab centrifuge to remove unreacted lime and other solids. Finally, the mixture was heated at 170° C. under vacuum (15 mbar) to remove any remaining xylene and to obtain an oil concentrate of an overbased calcium alkyl-substituted hydroxybenzoate detergent containing 5.84 wt. % Ca and having a TBN of 163.5.

Example 2

Preparation of 350 TBN $C_{26}$ to $C_{28}$ Calcium Alkyl-Substituted Hydroxybenzoate Step A)—Formation of the Alkali Metal Base Alkylphenate.

An alkyphenol (1500 g), prepared from a linear $C_{26}$-$C_{28}$ normal alpha olefin containing predominantly $C_{26}$ at 58% and $C_{28}$ at 36%, the reminder being $C_{24}$ and $C_{30}$, of average molecular weight of 480 g/mol estimated by GC and HPLC was charged together with xylene (750 g), a 45% solution of KOH in water (367 g) and 0.2 g of silicon antifoam agent in a 3 neck round bottom flask equipped with a Dean-Stark distillation apparatus. The mixture was heated at 135° C. at reduce pressure (450 mmHg) for 6 hours during which xylene and water are continuously distilled with xylene recycled back to the flask.

Step B)—Carboxylation.

The reactor containing the alkali metal alkylphenate in xylene from step A) was allowed to cool and the mixture was left overnight under nitrogen. The next day, the reactor was heated to 140° C. and pressurized with $CO_2$ at 3 bar and maintained under these conditions for 4 hours. At the end of this period, the content of the reactor was allowed to cool down to recover the potassium alkyl hydroxybenzoate in xylene. Next, the potassium alkyl hydroxybenzoate in xylene (1200 g) was introduced into a round bottom flask followed by xylene (722 g) and the mixture was heated to 80° C. A 10% solution of sulfuric acid (1069 g) was introduced slowly under stirring and the mixture was held at 70° C. for 30 minutes. The mixture was then transferred to a separating funnel and allowed to settle for 2 hours. After separation, the top layer containing the alkylhydroxybenzoic acid in xylene was recovered. The alkylhydroxybenzoic acid had an acidity measured by potentiometry of 36.2 mgKOH/g and a xylene content of 55.1%.

Step C)—Neutralization and Overbasing.

A slurry of 314.9 g of slaked lime in 207.7 g of methanol and 533.5 of xylene was prepared and introduced into a reactor. Then 1604.9 g (1.03 eq) of the alkyl-substituted hydroxybenzoic acid of step B) was loaded into the reactor and the temperature was held at 40° C. for 15 minutes. Once the alkylhydroxybenzoic acid was added, 16.1 g of a (50/50) mixture of acetic and formic acid was introduced leading to a slight temperature increase to 43° C. After cooling down to 38° C., $CO_2$ (105.5 g) was introduced in the reactor slowly while the temperature increased from 38 to 50° C. Next, another slurry of 59.9 g of slaked lime in 39.6 g of methanol and 335.7 g of xylene was prepared and introduced into the reactor. The reactor was then charged with 70.6 g of $CO_2$ while the temperature increased up from 50° C. to 60° C. The reaction yielded a calcium carbonate-overbased alkyl-substituted hydroxybenzoate.

Step D)—Predistillation, Centrifugation, and Final Distillation.

The mixture contained within the reactor was taken to a temperature of 128° C. This procedure removed methanol, water and a portion of the xylene. Next, a base oil (347.4 g) was added to the mixture. The mixture was then centrifuged in a lab centrifuge to remove unreacted lime and other solids. Finally, the mixture was heated at 170° C. under vacuum (15 mbar) to remove any remaining xylene and to obtain an oil concentrate of an overbased calcium alkyl-substituted hydroxybenzoate detergent containing 12.9 wt. % Ca and having a TBN of 361.2.

Examples 3 and 4 and Comparative Examples C and D

Trunk piston engine oils were prepared using the overbased calcium alkyl-substituted hydroxybenzoate detergent concentrates of Examples 1 and 2 and Comparative Examples A and B. The trunk piston engine oils of Examples 3 and 4 and Comparative Examples C and D contained the following components and amounts as set forth in Table 1. In each Example, secondary alkyl ZnDTP was added to achieve a final oil concentration of about 0.05 wt. % in terms of phosphorus content.

TABLE 1

| | Comp. Ex. C | Ex. 3 | Comp. Ex. D | Ex. 4 |
|---|---|---|---|---|
| Non-detergent components | | | | |
| ExxonMobil Core 600 N Group I base oil | 76.56 | 76.59 | 76.78 | 76.79 |
| ExxonMobil Core 2500 BS Group I base oil | 10.85 | 11.63 | 16.17 | 16.38 |
| Oil concentrate of secondary zinc dialkyl dithiophosphate | 0.67 | 0.67 | 0.67 | 0.67 |
| Silicone foam agent concentrate | 0.04 | 0.04 | 0.04 | 0.04 |
| Detergent components | | | | |
| 350 TBN Ca alkyl-substituted hydroxybenzoate detergent concentrate of Comp. Ex. B | 11.88 | — | — | — |
| 350 TBN Ca alkyl-substituted hydroxybenzoate detergent concentrate of Ex. 2 | — | 11.07 | — | — |
| 150 TBN Ca alkyl-substituted hydroxybenzoate detergent concentrate of Comp. Ex. A | — | — | 6.34 | — |
| 150 TBN Ca alkyl-substituted detergent hydroxybenzoate concentrate of Ex. 1 | — | — | — | 6.12 |
| TBN, mgKOH/g | 40.7 | 40.1 | 10.5 | 10.5 |
| Viscosity at 100° C., cSt | 14.3 | 14.6 | 14.2 | 14.7 |
| Viscosity at 40° C., cSt | 138 | 142 | 141 | 147 |
| Viscosity index | 102 | 101 | 98 | 99 |
| SAE viscosity grade | SAE 40 | SAE 40 | SAE 40 | SAE 40 |
| BSD, mg deposits | | | | |
| Low fuel oil concentration | 17.0 | 12.4 | 12.4 | 7.5 |
| High fuel oil concentration | 70.9 | 20.6 | 52.2 | 16.8 |

Residual fuel compatibility was evaluated by means of the black sludge deposit test as described below.

Black Sludge Deposit (BSD) Test

This test is used to evaluate the ability of a trunk piston engine oil to cope with unstable-unburned asphaltenes in the residual fuel oil. The test measures the tendency of lubricants to cause deposits on a test strip, by applying oxidative thermal strain on a mixture of heavy fuel oil and lubricant.

A sample of test oil was mixed with heavy fuel oil to form a test mixture. Each test mixture was pumped over a heated metal test strip, which is controlled at test temperature, for a specified period of time. After cooling and washing, the metal test strips were dried and weighted. The weight of each steel test strip was determined, and the weight of the deposit remaining on the steel test strip was measured and recorded as the change in weight of the steel test strip.

Tests were performed separately on each trunk piston engine oil using both a low and high concentration of added heavy fuel oil. As the data in Table 1 show, the addition of at least one detergent comprising a salt of an alkyl-substituted hydroxyaromatic carboxylic acid according to the present invention to the trunk piston engine oil significantly improves the residual fuel compatibility in all cases for both low and high residual fuel concentration. For example, the trunk piston engine oil of Example 3 containing a 350 TBN Ca alkyl-substituted hydroxyaromatic carboxylic acid detergent wherein the alkyl moiety of the alkyl-substituted hydroxyaromatic carboxylic acid is $C_{26}$ to $C_{28}$ and derived from a mixture of normal alpha olefins exhibited significantly and unexpectedly less deposit formation than the trunk piston engine oil of Comparative Example C containing 350 TBN Ca alkyl-substituted hydroxyaromatic carboxylic acid detergent wherein the alkyl moiety of the alkyl-substituted hydroxyaromatic carboxylic acid is $C_{20}$ to $C_{28}$ and derived from a mixture of normal alpha olefins, i.e., 20.6 mg deposits versus 70.9 mg deposits. In addition, the trunk piston engine oil of Example 4 containing a 150 TBN Ca alkyl-substituted hydroxyaromatic carboxylic acid detergent wherein the alkyl moiety of the alkyl-substituted hydroxyaromatic carboxylic acid is $C_{2-6}$ to $C_{28}$ and derived from a mixture of normal alpha olefins, also exhibited significantly and unexpectedly less deposit formation than the trunk piston engine oil of Comparative Example D containing 150 TBN Ca alkyl-substituted hydroxyaromatic carboxylic acid detergent wherein the alkyl moiety of the alkyl-substituted hydroxyaromatic carboxylic acid is $C_{20}$ to $C_{28}$ and derived from a mixture of normal alpha olefins, i.e., 16.8 mg deposits versus 52.2 mg deposits.

It will be understood that various modifications may be made to the embodiments disclosed herein. Therefore the above description should not be construed as limiting, but merely as exemplifications of preferred embodiments. For example, the functions described above and implemented as the best mode for operating the present invention are for illustration purposes only. Other arrangements and methods may be implemented by those skilled in the art without departing from the scope and spirit of this invention. Moreover, those skilled in the art will envision other modifications within the scope and spirit of the claims appended hereto.

What is claimed is:

1. A trunk piston engine lubricating oil composition comprising (a) a major amount of an oil of lubricating viscosity; (b) one or more carboxylate-containing detergents comprising an overbased calcium salt of an alkyl-substituted hydroxyaromatic carboxylic acid having a TBN of between 100 and 450, wherein at least about 90% of the alkyl moiety of the alkyl-substituted hydroxyaromatic carboxylic acid comprises $C_{26}$ to $C_{28}$ alkyl groups derived from one or more normal alpha olefins and the remainder being derived from one or more $C_{27}$ and $C_{30}$ normal alpha olefins; and (c) one or more zinc dithiophosphates in an amount of about 0.02 to about 0.12 wt. % in terms of phosphorus content.

2. The trunk piston engine lubricating oil composition of claim 1, having a total base number of at least about 10.

3. The trunk piston engine lubricating oil composition of claim 1, having a total base number of from about 20 to about 60.

4. The trunk piston engine lubricating oil composition of claim 1, wherein at least about 95% of the alkyl moiety of the alkyl-substituted hydroxyaromatic carboxylic acid comprises $C_{26}$ to $C_{28}$ alkyl groups derived from one or more normal alpha olefins.

5. The trunk piston engine lubricating oil composition of claim 1, wherein the composition contains no detergent that does not contain a salt of an alkyl-substituted hydroxyaromatic carboxylic acid.

6. The trunk piston engine lubricating oil composition of claim 1, further comprising less than about 2 wt. % of a polyalkylene succinimide.

7. The trunk piston engine lubricating oil composition of claim 1, further comprising less than about 2 wt. % of a polyisobutenyl bissuccinimide.

8. The trunk piston engine lubricating oil composition of claim 1, further comprising less than about 1 wt. % of an oxidation inhibitor.

9. The trunk piston engine lubricating oil composition of claim 1, wherein the one or more zinc dithiophosphates are present in an amount of about 0.02 to about 0.06 wt. % in terms of phosphorus content.

10. The trunk piston engine lubricating oil composition of claim 1, further comprising one or more trunk piston engine lubricating oil composition additives selected from the group consisting of an ashless dispersant other than a polyalkylene succinimide, anti-wear agent other than a zinc dithiophosphate, rust inhibitor, dehazing agent, demulsifying agent, metal deactivating agent, friction modifier, pour point depressant, antifoaming agent, co-solvent, package compatibiliser, corrosion-inhibitor, dye, extreme pressure agent and mixtures thereof.

11. A method for reducing black sludge and deposit formation in a trunk piston engine, the method comprising lubricating the trunk piston engine with a trunk piston engine lubricating oil composition comprising (a) a major amount of an oil of lubricating viscosity; (b) one or more carboxylate-containing detergents comprising an overbased calcium salt of an alkyl-substituted hydroxyaromatic carboxylic acid having a TBN of between 100 and 450, wherein at least about 90% of the alkyl moiety of the alkyl-substituted hydroxyaromatic carboxylic acid comprises $C_{26}$ to $C_{28}$ alkyl groups derived from one or more normal alpha olefins and the remainder being derived from one or more $C_{24}$ and $C_{30}$ normal alpha olefins; and (c) one or more zinc dithiophosphates in an amount of about 0.02 to about 0.12 wt. % in terms of phosphorus content.

12. The method of claim 11, wherein the trunk piston engine lubricating oil composition has a total base number of at least about 10.

13. The method of claim 11, wherein the trunk piston engine lubricating oil composition comprises one or more zinc dithiophosphates in an amount of about 0.02 to about 0.06 wt. % in terms of phosphorus content.

14. The method of claim 11, wherein the trunk piston engine lubricating oil composition further comprises less than about 2 wt. % of a polyalkylene succinimide.

15. The method of claim 11, wherein the trunk piston engine lubricating oil composition further comprises less than about 2 wt. % of a polyisobutenyl bissuccinimide.

16. The method of claim 11, wherein the trunk piston engine lubricating oil composition further comprises less than about 1 wt. % of an oxidation inhibitor.

17. The method of claim 11, wherein the trunk piston engine lubricating oil composition further comprises one or more trunk piston engine lubricating oil composition additives selected from the group consisting of an ashless dispersant other than a polyalkylene succinimide, anti-wear agent other than a zinc dithiophosphate, rust inhibitor, dehazing agent, demulsifying agent, metal deactivating agent, friction modifier, pour point depressant, antifoaming agent, co-solvent, package compatibiliser, corrosion-inhibitor, dye, extreme pressure agent and mixtures thereof.

18. The trunk piston engine lubricating oil composition of claim 1, wherein the overbased calcium salt of an alkyl-substituted hydroxyaromatic carboxylic acid has a TBN of between 125 and 400.

19. The method of claim 11, wherein the overbased calcium salt of an alkyl-substituted hydroxyaromatic carboxylic acid has a TBN of between 125 and 400.

* * * * *